US006278619B1

(12) United States Patent
Dumont

(10) Patent No.: US 6,278,619 B1
(45) Date of Patent: Aug. 21, 2001

(54) CIRCUIT BREAKER FOR LOW VOLTAGE ALTERNATING ELECTRIC INSTALLATION

(75) Inventor: Roger Dumont, Benfeld (FR)

(73) Assignee: Socomec S.A., Benfeld (FR)

( * ) Notice: Subject to any disclaimer, the term of this patent is extended or adjusted under 35 U.S.C. 154(b) by 0 days.

(21) Appl. No.: 09/462,614

(22) PCT Filed: May 12, 1999

(86) PCT No.: PCT/FR99/01134

§ 371 Date: Jan. 10, 2000

§ 102(e) Date: Jan. 10, 2000

(87) PCT Pub. No.: WO99/59177

PCT Pub. Date: Nov. 18, 1999

(30) Foreign Application Priority Data

May 14, 1998 (FR) ..... 98 06272

(51) Int. Cl.[7] ..... H01H 3/42; H01H 1/20; H01H 19/62

(52) U.S. Cl. ..... 361/837; 361/622; 361/626; 337/10; 337/123; 337/138; 337/305; 200/27 R; 200/23; 200/30 R; 200/573; 200/238

(58) Field of Search ..... 361/104, 103, 361/601, 622, 626, 641, 642, 837; 337/1, 4, 6–11, 35, 123, 126, 138, 301, 302, 303, 305, 382, 384; 200/19 R, 20–26, 27 A, 27 B, 27 R, 28, 29, 30 R, 31 R, 31 A, 38 R, 33 B, 573, 574, 238, 273

(56) References Cited

U.S. PATENT DOCUMENTS

| | | | | |
|---|---|---|---|---|
| Re. 31,597 | * | 6/1984 | Fischer et al. | 219/507 |
| 2,245,369 | * | 6/1941 | Smith | 200/16 |
| 3,869,688 | * | 3/1975 | Aldous | 337/82 |
| 3,928,740 | * | 12/1975 | Alsch | 200/153 LB |
| 4,103,132 | * | 7/1978 | Schwarzkopf | 200/153 LB |
| 4,713,498 | * | 12/1987 | Ludwig et al. | 200/5 R |
| 4,861,949 | * | 8/1989 | Bortolloni et al. | 200/5 R |
| 5,075,517 | * | 12/1991 | Spanio | 200/16 A |
| 5,191,310 | * | 3/1993 | Obermann et al. | 337/105 |

FOREIGN PATENT DOCUMENTS

| | | | | |
|---|---|---|---|---|
| 352024A | | 3/1961 | (CH) . | |
| 2049020 | | 3/1972 | (DE) . | |
| 0105817 | | 4/1984 | (EP) . | |
| 0252285 | | 1/1988 | (EP) . | |
| 4-149921 | * | 5/1992 | (JP) | 200/568 |
| 6-44864 | * | 2/1994 | (JP) | H01H/19/58 |
| 9-231867 | * | 9/1997 | (JP) | H01H/19/58 |
| 11-232966 | * | 8/1999 | (JP) | H01H/19/20 |

* cited by examiner

*Primary Examiner*—Leo P. Picard
*Assistant Examiner*—Anatoly Vortman
(74) *Attorney, Agent, or Firm*—Davis & Bujold, P.L.L.C.

(57) ABSTRACT

The invention concerns a disconnecting appliance, such as a switch, a fuse-disconnecting switch or breaker-reversing switch, having a novel arrangement of fixed and moving contacts promoting contact surface self-cleaning and increasing contact force for the same contact force applied by the cam. Moreover, it comprises a newly designed cam for actuation the mobile contacts to optimize to the maximum the operating conditions when engaging and releasing. The appliance is characterized in that the moving contacts (35, 36) comprise two contact surfaces (38) arranged in substantially perpendicular planes, corresponding with those (27) of the fixed contacts (31, 31' and 33, 33'), each moving contact (35, 36) moving in radial translation relative to the control shaft (23) along a direction (F) substantially perpendicular to a straight line passing through its two contact surfaces (38). The cam (50) comprises a flow track (56) and a return track (57), respectively corresponding to engaging and releasing, to guide a driving pin (45) integral with a moving element (40) coupled to the moving contacts, the moving element being arranged to be translated radially relative to the control shaft (23). The invention is applicable to any industrial electrical installation.

14 Claims, 5 Drawing Sheets

CIRCUIT BREAKER FOR LOW VOLTAGE ALTERNATING ELECTRIC INSTALLATION

The present invention relates to an electrical disconnector for an alternating low voltage electrical installation provided with at least two phase conductors with or without a neutral conductor, comprising one disconnecting module per conductor and one control module provided with a mechanism for operating said disconnecting modules, each disconnecting module comprising at least one input terminal connected to a fixed contact, one output terminal connected to a fixed contact, another two fixed contacts connected to one another by a bridge or a fuse, forming with the other fixed contacts two pairs of fixed contacts and two moving contacts associated respectively with a pair of fixed contacts, an engaged position and a released position, the control module comprising at least one control shaft coupled to an operating handle, this shaft crossing said disconnecting modules and bearing at least one cam coupled to at least one translation moving element coupled to said moving contacts to be moved from a first stable position called the engaged position to a second stable position called the released position.

BACKGROUND OF THE INVENTION

These disconnectors, commonly called switches, fuses-switches or change-over switches are designed to distribute energy to electrical installations or to control alternating low voltage industrial equipment, for example 380 V, and in a current range from a few dozen to a few thousand amps. So-called double disconnectors comprise two moving contacts per pole or disconnecting module. More often than not, the moving contacts are made up of a rectilinear bar which performs a perfect translation movement between its two stable positions and the fixed contacts of a same pair are arranged in the same plane parallel to said moving contact. The translation movement of the moving contacts is traditionally obtained by a cam securely fixed at its center to the disconnecting modules control shaft. The cam may have an almost oval shape and comprise a guide path on its section. In this case, each moving contact is connected to a moving element provided on either side of the control shaft and applied against the section of the oval cam by means of a spring. The rotation of the cam generated by the rotation of the control shaft drives the moving element in a radial translation movement transmitted simultaneously to the corresponding moving contact. The virtually oval shape of the cam is generally optimized to allow a sudden disconnection and an optimum operating force. The cam can also be round on which the moving elements are fixed at out-of-center points, thereby forming a rod-wheel system. In this way, the rotation of the cam also drives the radial translation of the moving element which is transmitted to the corresponding moving contact.

The known disconnectors described briefly above present numerous drawbacks. Due to the fact that the moving contacts perform a perfect translation movement, there is no friction between the moving contacts and the fixed contacts when engaging and releasing takes place. Consequently, there is no self cleaning of the contact surfaces. This is detrimental to the quality of the electrical contact. In particular, the contact resistance increases with the number of operations performed and the number of electric arcs established between the fixed and moving contacts. The deterioration in the quality of electrical contact causes the contact surfaces and the device in general to heat up, leading to Joule effect losses, as well as a reduction in the lifetime of both the contacts and the device. Furthermore, in the standard devices, there is a relatively large number of parts. In particular, several intermediate current-carrying parts have to be arranged to achieve the complete circuit from the input terminal to the output terminal. As these parts are frequently made of copper, the cost price of the disconnecting modules remains relatively high. Furthermore, the force applied to the moving contact corresponds to that applied by the cam securely fixed to the control shaft which is itself securely fixed to the operating handle. However, due to the fact that each rectilinear moving contact co-operates with two fixed contacts arranged in the same plane, the force applied on each fixed contact corresponds to half the force transmitted by the cam. This implies increasing the operating force on the handle to increase the force on the contacts, which is contrary to the objective being sought when engaging. What is more, in standard disconnecting devices, the speed and the distance the moving contacts move according to the time are identical when engaging and releasing, which is detrimental to optimizing the physical conditions in either of the stable positions. Indeed, when engaging, the smallest possible operating force is sought, as well as the quickest possible engaging speed. On the other hand, when releasing, a sudden disconnection is sought to avoid electric arcs occurring as much as possible, as well as good resistance to a force equal to three times the operating force, commonly called 3F and defined by an international standard.

Some publications describe electrical disconnecting devices designed to create friction between the fixed and moving contacts when engaging takes place. This is notably the case in publications EP-A-252 285, EP-A-105 817 and CH-A-352 024. Nevertheless, none of them provides for a special layout of the contacts making it possible to increase the contact force between them, nor different trajectories of the moving contacts for the engaging and the releasing operations in order to optimize the operating conditions.

In publication EP-A-252 285, it is a matter of a circuit breaker limited to low currents (under 32 A) for domestic applications, which is provided with a single disconnecting module and not an industrial switch provided with several disconnecting modules. What is more, the contact surfaces provided on the fixed contact and the moving contact are coplanar. It is the mechanism for transmitting movement between the circuit breaker's lever and the moving contact which generates a friction movement between the two contacts.

In publication EP-A-105 817, it is a question of a multi-stage switch limited to currents from 25 to 32 A whose cam mechanism is only designed to ensure self-cleaning of the contacts by means of an auxiliary cam which controls a carriage which moves the moving contacts by friction on the fixed contacts. The contact surfaces provided on these fixed and moving contacts are also coplanar.

In publication CH-A-352 024, it is a matter of a switch with two moving contacts, whose contact surfaces are also coplanar, controlled by a central rotating cam. The approach movement of the moving contacts is performed according to an angle of 20 to 30° which, when contact is made, leads to a pressure and self-cleaning friction on the contacts.

SUMMARY OF THE INVENTION

The aim of the present invention is to overcome these drawbacks by proposing a disconnector which presents a new layout of moving and fixed contacts which favors the self cleaning of the contact surfaces and increases the contact force for the same force applied by the cam. What is more, the disconnector proposed comprises a newly arranged cam making it possible to meet the various characteristics required when engaging and releasing in order to optimize the operating conditions.

This aim is achieved for such a disconnector as defined in the preamble and characterized in that each moving contact comprises two contact surfaces arranged in substantially perpendicular planes, in that the fixed contacts of the same pair are arranged in substantially perpendicular planes so that their respective contact surface is placed facing the corresponding contact surface provided on said moving contact when it is in the engaged position and in that each moving contact moves in radial translation in relation to the control shaft in a substantially perpendicular direction to a straight line passing by its two contact surfaces.

In a preferred form of embodiment, each moving contact comprises two end arms arranged on either side of a middle arm, forming an angle of approximately 45° in relation to said middle arm, the contact surfaces being provided on the two end arms.

The moving element is, advantageously, made up of a substantially rectangular frame extending at right angles through said disconnecting modules and arranged in a substantially inclined plane parallel to the control shaft.

The frame can comprise at least two parallel sides, oriented radially in relation to the control shaft and arranged to slide along two corresponding sides arranged in the enclosure of said device to guide said frame in translation.

In the preferred form of embodiment, for each corresponding moving contact, the frame comprises a window oriented substantially perpendicular to the control shaft and a return spring housed in this window to attract said moving contact in the direction of the fixed contacts.

The frame also comprises at least one notch designed to receive said cam, at least one side of this notch comprising a drive finger substantially parallel to the control shaft and engaged in at least one track provided in said cam.

Preferentially, the cam comprises, for each moving element, a non circular recess, delimited by an inner wall close to the control shaft and an outer wall at a distance from the control shaft, these walls being arranged to guide said drive finger, respectively when engaging and releasing.

The bottom of the recess advantageously comprises various reliefs arranged to define, respectively with the inner and outer walls, two distinct tracks, i.e. an out track for engaging purposes and a return track for releasing purposes.

In the preferred form of embodiment, the out track comprises a first part which is substantially rectilinear and a second circular part with a small radius out-of-center in relation to the control shaft and the return track comprises a first circular part with a constant radius centered on the control shaft and a second circular part the radius of which is smaller than said constant radius.

Advantageously, the second part of the out track communicates with the first part of the return track via a shoulder.

This cam advantageously comprises a central barrel rotating securely fixed to the control shaft and sliding on the latter and the width of the notch provided in the moving element's frame is greater than that of the cam which allows it an axial clearance corresponding to the differences in relief at the bottom of the recess.

In the preferred embodiment, on at least one of its free ends, the barrel has a cam profile co-operating with at least one lug provided at least in the enclosure of said device and oriented radially in relation to the control shaft and the control shaft bears a return spring arranged to keep the cam profile resting on said lug.

In an alternative embodiment, the recess can be extended, in a direction opposite to that of the out and return tracks, by a test track, framed by the inner and outer walls, this track being circular, close to the control shaft, with a constant radius centered on this shaft.

In this alternative, the cam comprises on its rear side a circular groove near the control shaft and centered on this shaft and the frame of the moving element comprises a guide shoe 46 arranged facing the drive finger 45 and arranged to lodge itself in said groove when the device is in the test position.

BRIEF DESCRIPTION OF THE DRAWINGS

The present invention and its advantages shall be more fully disclosed in the following description of an example of embodiment, given by way of an unrestricted example with reference to the attached drawings, in which.

DESCRIPTION OF THE PREFERRED EMBODIMENTS

Figure 1:
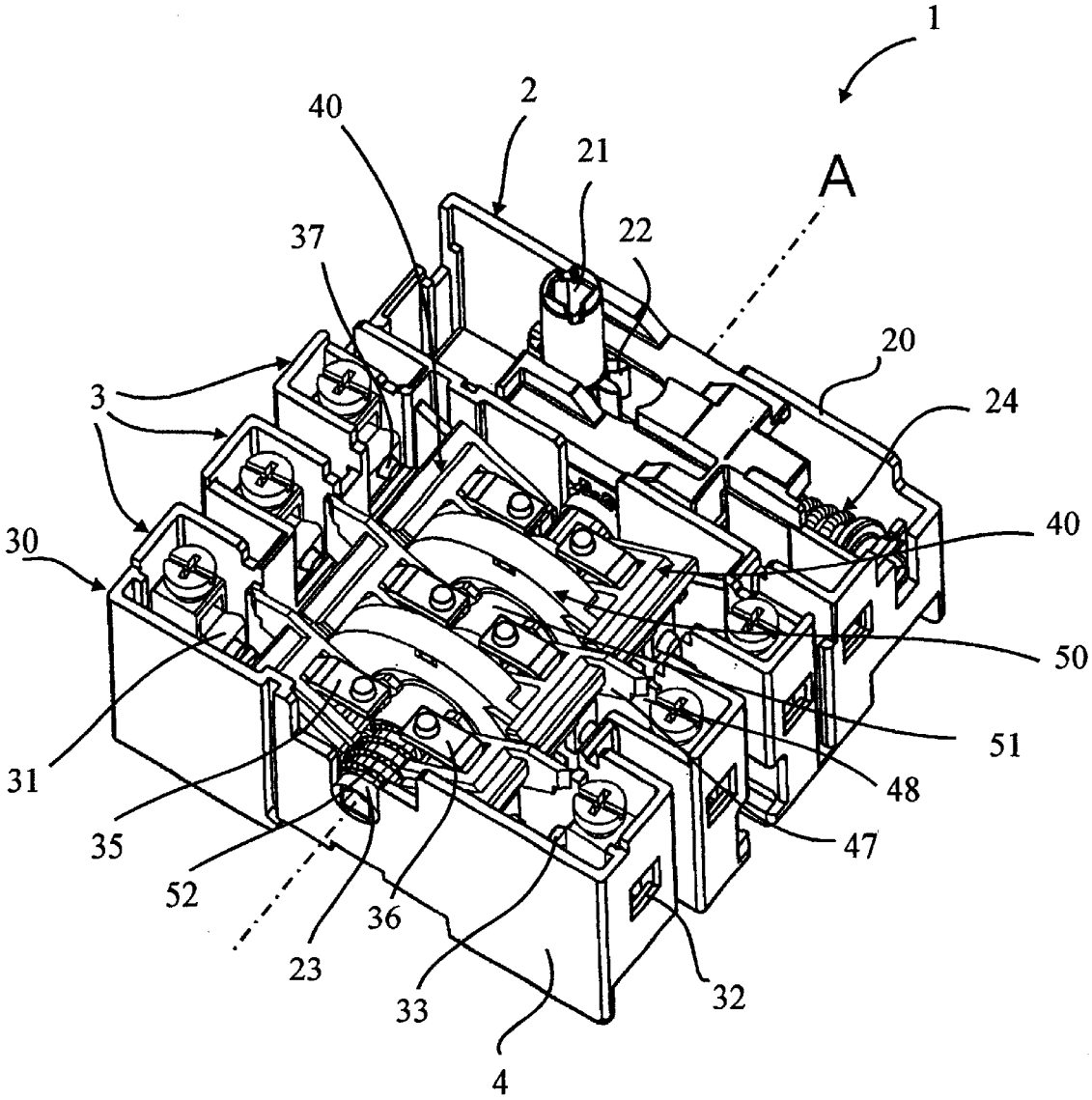
FIG. 1 shows a perspective of a disconnector according to the invention, with the covering cap withdrawn, the device being in the released position.

With reference to FIG. 1, the disconnector 1 according to the invention comprises, in the example shown, one control module 2 and three disconnecting modules 3. This device is designed for a three-phase electrical installation, i.e. provided with three phase conductors, but could be adapted to any other installation. The disconnecting modules 3 are either made up of independent, juxtaposed enclosures which are assembled using any known means, or grouped together in a single enclosure 4. Each disconnecting module 3 is associated with a conductor from said installation and comprises in a known manner one input terminal 30 connected to a fixed contact 31, one output terminal 32 connected to a fixed contact 33, two other fixed contacts 31', 33' (not shown on this Figure) securely fixed to the device's covering cap, connected to one another by a current-carrying bridge 34 (not shown on this Figure) or a fuse forming two pairs of fixed contacts, with the other fixed contacts 31, 33, as well as two moving contacts 35, 36 each associated with a pair of fixed contacts 31, 31' and 33, 33', having two stable positions, an engaged position and a released position. The fixed contacts 31, 31', 33, 33' each comprise one contact surface made up of a contact piece 37 and the moving contacts 35, 36 each comprise two contact surfaces made up of contact pieces 38 arranged to rest against the contact pieces 37 when the disconnector 1 is in the engaged position. The moving contacts 35, 36 are mounted respectively in two identical, moving elements 40 arranged symmetrically in relation to the axis A of said disconnector 1 and moving in translation according to two opposite directions and substantially perpendicular to said axis A.

The control module 2 comprises in a known manner an enclosure 20, a transmission shaft 21 connected to an operating handle (not shown) accessible from outside said enclosure and coupled by means of toothed pinions 22, constituting a change of direction, to a control shaft 23 for the moving contacts 35, 36, arranged in the axis A and crossing the disconnecting modules 3. Nevertheless, the operating handle may be coupled directly to one of the ends of the control shaft 23 depending on the configuration one wishes to give said disconnector. This arrangement is possible as, as shall be seen later on, the operating clearance is situated at the mechanism for controlling the disconnecting modules and no longer at the control module.

The control shaft 23 is securely fixed to each moving contact 35, 36 to control them simultaneously in a synchronous and sudden manner. This control module 2 also comprises a sudden action device 24 by accumulation of energy, connected to said control shaft 23 and arranged to bring about a quick engaging and releasing of the moving contacts in relation to the fixed contacts. This sudden action device 24 makes it possible in a known manner to avoid the stagnation of electric arcs when releasing, premature arc ignition when engaging and comprises a spring mounted in such a way that all the intermediate positions between the engaged and released positions of the disconnector are unstable.

The control shaft 23 bears two identical cams 50 each mounted on a barrel 51 able to slide axially in relation to said shaft 23. These cams 50 are pushed in the direction of the control module 2 by means of a return spring 52 arranged on the control shaft 23 between one lateral side of the enclosure 4 and the closest barrel 51. Each cam 50 is designed to co-operate with the two moving elements 40 so as to move the moving contacts 35, 36 synchronously from their released position to their engaged position and vice-versa.

Figure 2:
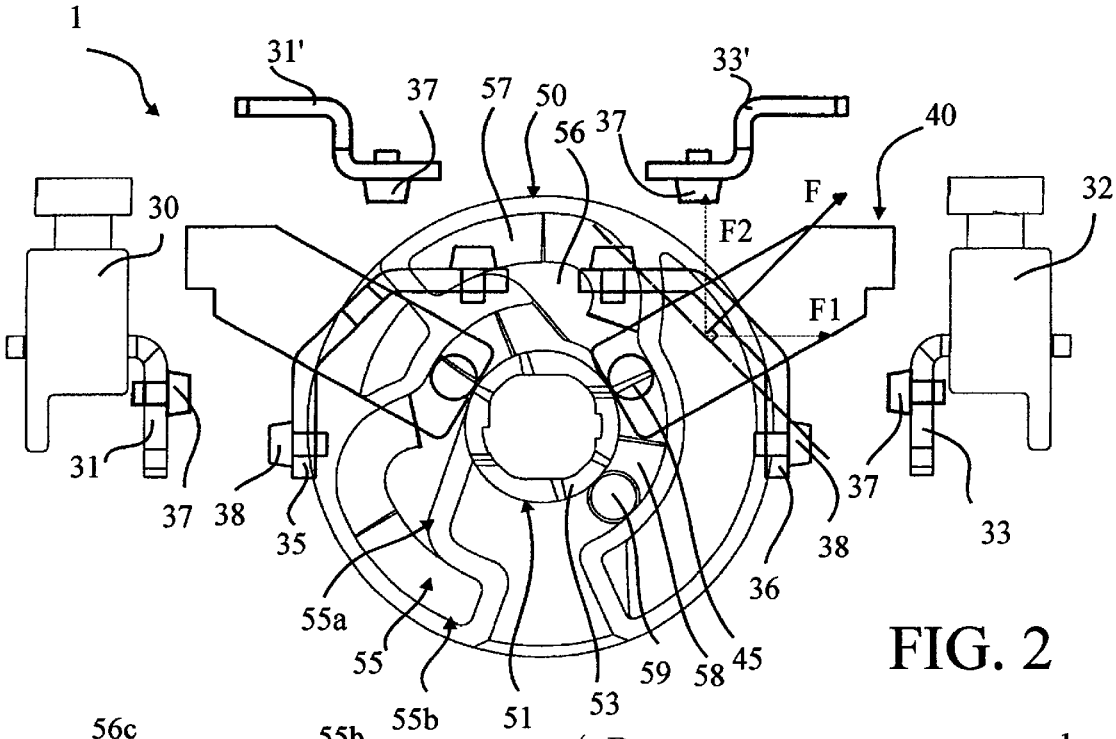
FIG. 2 is a partial plan view, the main elements being shown in a transparent manner, the device being in the released position.
Figure 3:
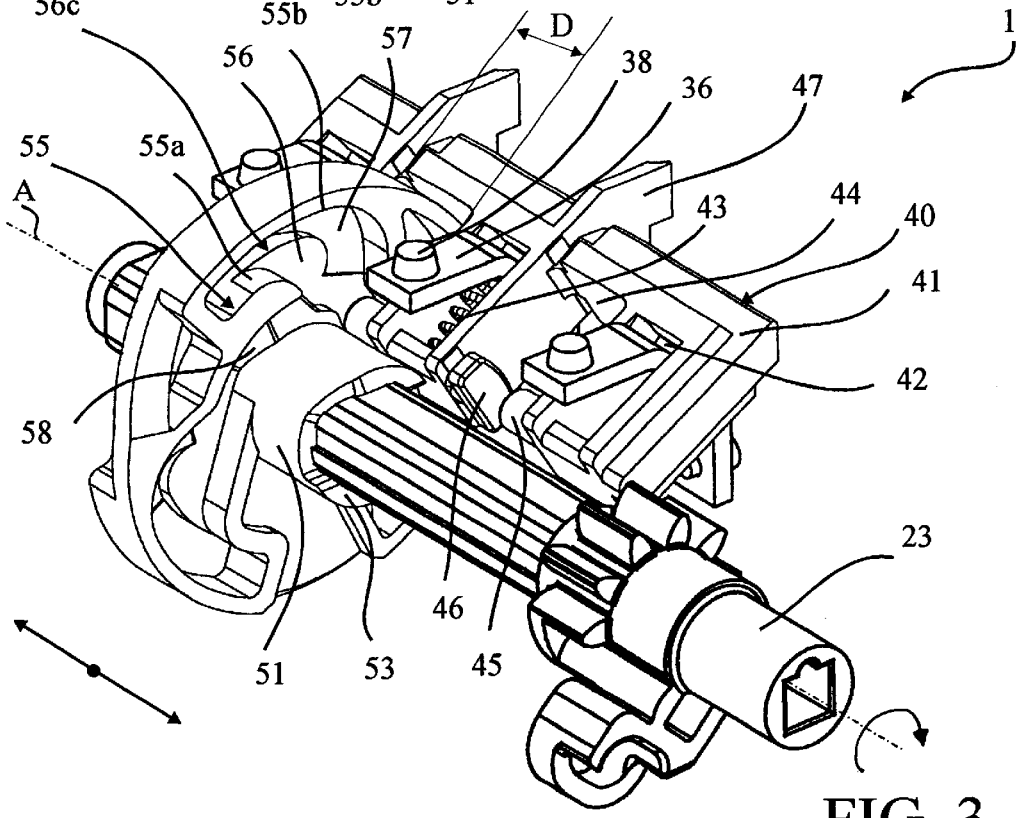
FIG. 3 is a partial perspective of the device in the released position.
Figure 4:
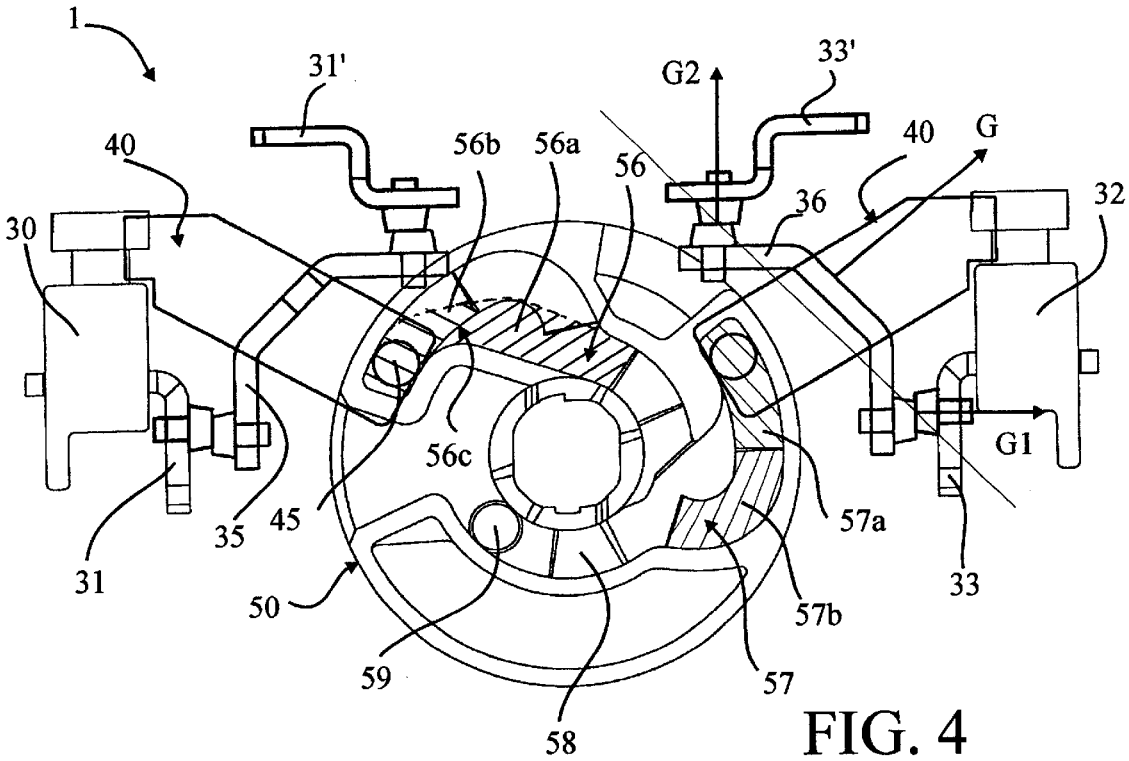
FIG. 4 is a partial plan view, the main elements being shown in a transparent manner, the device being in the engaged position.
Figure 5:
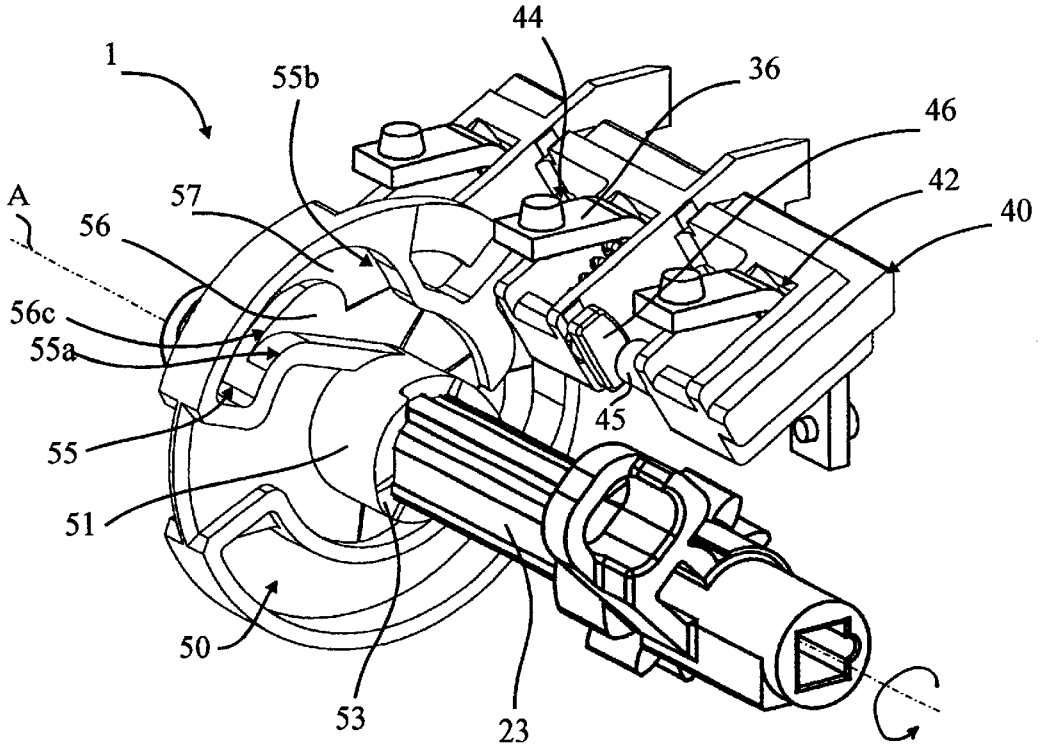
FIG. 5 is a partial perspective of the device in the engaged position.
Figure 6:
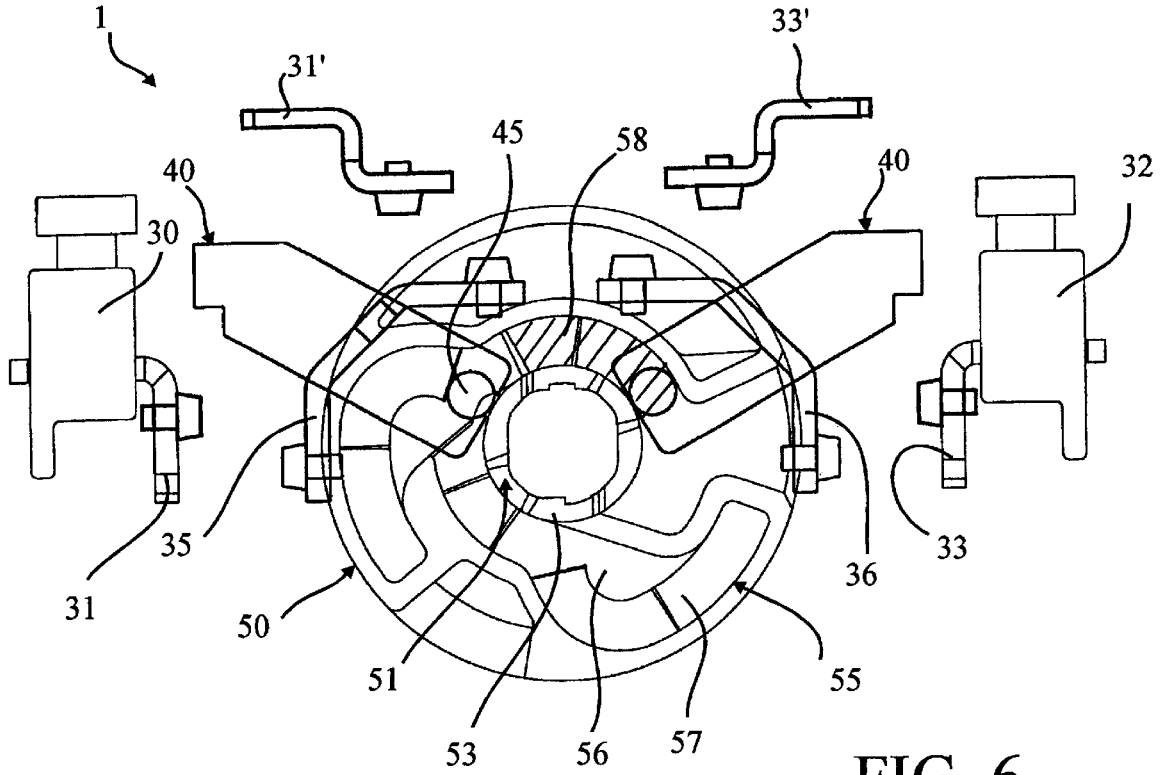
FIG. 6 is a partial plan view, the main elements being shown in a transparent manner, the device being in the test position.
Figure 7:
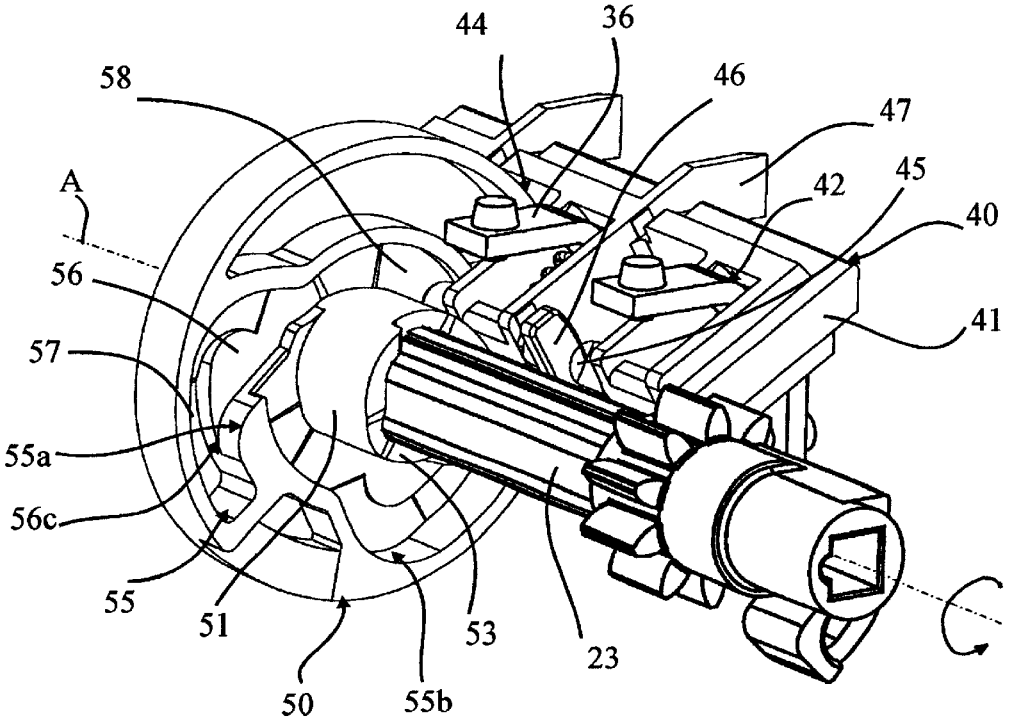
FIG. 7 is a partial perspective of the device in the test position.

FIGS. 2 to 7 partially illustrate the disconnector 1 by showing the main parts which make up the present invention, in various positions. In FIGS. 2, 4 and 6, the parts are shown in a transparent manner, seen from the end of the control shaft 23. In FIGS. 3, 5 and 7, these parts are shown in perspective. The parts making up said disconnector 1 are almost all symmetrical in relation to the axis A.

The input terminals 30 and output terminals 32 are connected respectively to the fixed contacts 31 and 33. These fixed contacts 31, 33 are each made up of a current-carrying bar bent at a right angle, with one of the arms being lodged in the corresponding terminal and the other arm bearing a contact piece 37 which is riveted for example. The other two fixed contacts 31', 33' are made up of a current-carrying bar bent twice at a right angle to form a step, with one of the arms being lodged in the device's covering cap and the other arm bearing a contact piece 37. The fixed contacts form two by two pairs of fixed contacts 31, 31' and 33, 33', the contact pieces 37 of which are arranged in perpendicular planes. The fixed contacts 31', 33' are connected to one another either by means of a bridge forming a basic switch, or by means of a fuse cartridge forming a fuse-switch.

The moving contacts 35, 36 are made up of a current-carrying bar comprising two end arms arranged on either side of a middle arm and forming with it a substantially 45° angle. Each end arm bears a contact piece 38, which is riveted for example. The contact pieces 38 of the same moving contact are arranged in perpendicular planes and are designed to be in contact with the contact pieces 37 of the pair of corresponding fixed contacts, in the engaged position. The moving contacts 35, 36 are mounted respectively in the moving elements 40 arranged to move them simultaneously, in a synchronous manner, in translation in a direction F perpendicular to a straight line passing through the two contact pieces 38.

The bent or possibly rounded form of the moving contacts 35, 36 as well as the 45° approach of the moving contacts in relation to the fixed contacts make it possible to ensure self-cleaning of the contact pieces 37, 38 for each engaging and releasing operation. Indeed, the contact pieces 38 are positioned on the contact pieces 37 or move away from them according to the translation movement F which is broken down into a horizontal component F1 and a vertical component F2, each component generating friction between the contact pieces 37, 38. Furthermore, the operating force G transmitted to the moving contacts 35, 36 is passed on to the fixed contacts 31, 33 according to the horizontal component G1 and on to the fixed contacts 31', 33' according to the vertical component G2. As the angle of said operating force G is 45°, since it is parallel to the direction F, the value of the components G1 and G2 is equal to $G/\sqrt{2}$, i.e. greater than G/2 as in the state of the technique. Therefore, for the same operating force, the contact force is increased by 40%. This results in the electrical characteristics being improved: the breaking capacity and the short-circuit behavior are substantially improved. Furthermore, the special construction of the fixed contacts and the moving contacts makes it possible to halve the total length of copper required, which leads to a reduction in the cost price of the whole disconnector 1.

The moving elements 40 are each made up of a frame 41 which is substantially rectangular and extends into the three disconnecting modules and is arranged in an inclined plane passing through the control shaft 23. This frame 41 comprises three rectangular windows 42, oriented radially in relation to the control shaft 23 and designed to receive the moving contacts 35, 36 of said modules. The width of the windows 42 is slightly bigger than that of the moving contacts 35, 36 so as to provide said operating clearance mentioned previously. As a result, the frame 41 floats slightly in relation to the rest of the mechanism. A return spring 43 is provided in each window 42 to hold said moving contacts 35, 36, in their flat middle arm, resting against said frame 41 oriented outwards, i.e. away from the control shaft 23, in the direction of the fixed contacts. These springs 43 are centered in relation to their window 42 by means of a notch (not visible) provided on the frame 41. This frame 41 also comprises two housings 44 which are also rectangular, designed to receive the two cams 50. On the sides facing each housing 44, a drive finger 45 oriented parallel to the axis A and a guide shoe 46 are provided respectively, each co-operating with the opposing sides of the corresponding cam 50. The width of the housings 44 is approximately equal to twice that of the cams 50, thereby allowing them an axial clearance D which shall be dealt with in detail later. This frame 41 is extended outwards by at least two transversal sides 47 arranged to slide against corresponding transversal sides 48 provided in the enclosure 4 of the disconnecting modules 3, so as to guide said moving element 40 in its translation movement. Each moving element 40 is thereby driven by its two fingers 45 guided in the two cams 50, so as to ensure its radial translation movement parallel to the axis A.

Figure 9:
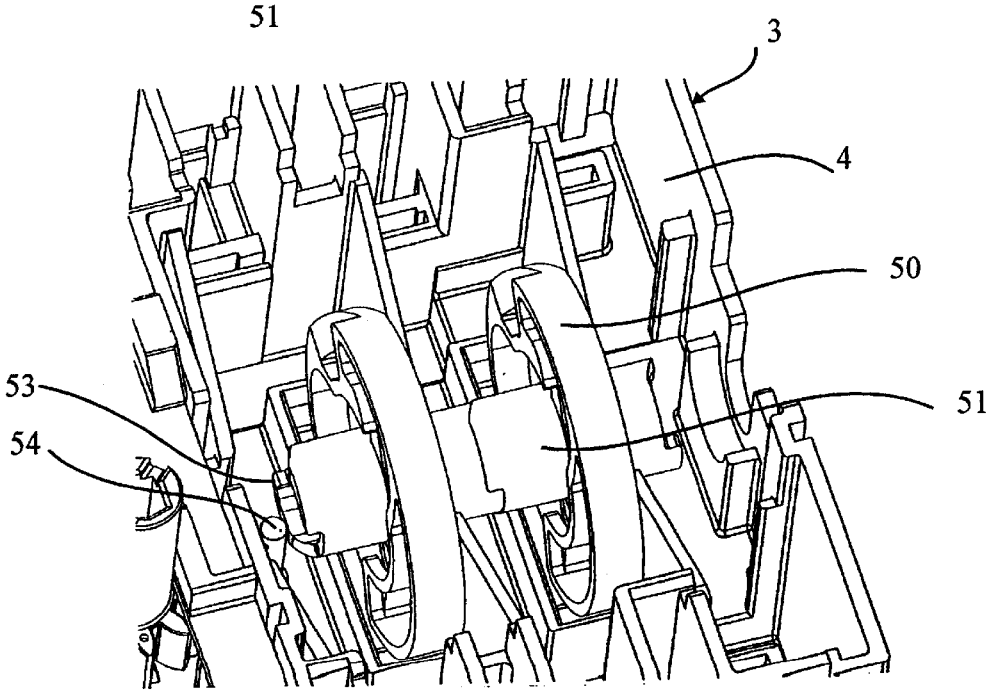
FIG. 9 is a partial perspective showing details of the enclosure.

Each cam 50 comprises a barrel 51 mounted slidingly on the control shaft 23 corresponding to the axial clearance D mentioned above. The free end of this barrel 51 presents left cam profile 53 co-operating with two facing lugs 54 provided respectively on the enclosure 4 (cf FIG. 9) and the cap (not shown) of said device 1, on the control module 2 side. This cam profile 53 makes it possible on the one hand to mechanically couple two consecutive barrels 51 when two cams 50 are mounted on the control shaft 23 and on the other hand allows the axial clearance D of said cams, the purpose of which will be specified later. The return spring 52 (cf FIG. 1) keeps this cam profile 53 resting on the lugs 54. The cams 50 are arranged to simultaneously move the two moving elements 40, synchronously and in translation according to F, and for this purpose they comprise two non circular recesses 55 on the drive fingers 45 side, i.e. the distance of which up to the axis A varies according to the angle of rotation, these two recesses being identical and offset by an angle of 120°. The details which follow concern one single recess 55 co-operating with the drive finger 45 of one single moving element 40 associated with one single set of moving contacts 36.

This recess 55 is defined laterally by an inner wall 55*a* close to the axis A and an outer wall 55*b* away from the axis A, the purpose of these walls being to guide the drive finger 45. The bottom of the recess 55 comprises various reliefs defining, respectively with the inner wall 55*a* and external wall 55*b*, two distinct tracks 56, 57, the purpose of which is also to guide the drive finger 45: one out track 56 to guide the finger 45 from the released position to the engaged position and one return track 57 to guide the finger 45 from the engaged position to the released position.

The way the cam 50 associated with the drive finger 45 operates is detailed with reference to FIGS. 2 and 3 showing the released position and FIGS. 4 and 5 showing the engaged position.

When the engaging operation takes place, i.e. to go from the released position (cf FIGS. 2 and 3) to the engaged position (cf FIGS. 4 and 5), the smallest possible operating force is sought, along with a good electrical contact between the moving contacts and the fixed contacts. The out track 56 therefore comprises two parts (for more details see FIG. 4 in which the parts are hatched): a first part which is substantially rectilinear 56*a* and a second circular part 56*b* with a small radius. In the first part 56*a* of the out track 56, the movement of the operating handle of the disconnector 1 generates a proportional travel of the moving element 40 and therefore the moving contacts 36. In the second part 56*b* and starting at the point of equilibrium between parts 56*a* and 56*b*, the movement of the operating handle leads to the moving element 40 moving and closing in quickly, which has the effect of quickly positioning and squeezing the moving contacts 36 on the corresponding fixed contacts 33, 33'. The out track 56 presents a variable depth which increases in the direction of rotation and then a sudden change of level caused by a shoulder 56*c*. Hence, at the end of the rotation, the cam 50 moves axially by a value equal to the difference in depth, slackening the return spring 52. This axial movement of the cam 50 offers the advantage of positioning the drive finger 45 immediately in the return track 57.

When the releasing operation takes place, i.e. to go from the engaged position (cf FIGS. 4 and 5) to the released position (cf FIGS. 2 and 3), what is sought is to achieve the most sudden separation possible between the moving contacts and the fixed contacts. The return track 57 therefore comprises two parts (for more details see FIG. 4 in which the parts are hatched): a first circular part 57*a* with a constant radius centered on the axis A and a second circular part 57*b*, the radius of which is much smaller than the constant radius. In the first part 57*a* of the return track 57, the movement of the operating handle of the disconnector 1 has no effect on the movement of the moving element 40 and therefore on that of the moving contacts 36. Nevertheless, the energy is stored in the sudden action device 24. In the second part 57*b* and starting at the point of equilibrium between the parts 57*a* and 57*b*, the movement of the operating handle, in association with the sudden action device 24, leads to the moving element 40 and therefore the moving contacts 36 being moved quickly away, resulting in a sudden disconnection. The return track 57 presents a variable depth which decreases in the direction of rotation. Hence, during this rotation, the cam 50 moves axially by a value equal to the difference in depth, compressing the return spring 52. This axial movement of the cam 50 has the advantage of positioning the drive finger 45 immediately at the starting point, in the out track 56.

The out track 56 and return track 57 have different reliefs so as to ensure that the drive finger 45 is guided properly in the right track so that it is guided, during the engaging operation, by the inner wall 55*a* of the recess and, during the releasing operation, by the outer wall 55*b*. Furthermore, to avoid too much force being exerted on the drive fingers 45 of the moving elements 40, the axial movement of the cams 50 induced by the relief of the out and return tracks, is helped by the adapted cam profile 53 provided on the barrel 51. This cam profile 53 rests on the lugs 54 securely fixed to the enclosure 4 and the cap of the device 1 and helps the cams 50, in association with the spring 52, to move axially during their rotation.

The out track 56 and return track 57 can present other curves and reliefs so as to optimize the engaging and releasing conditions for each disconnector 1.

Figure 8:
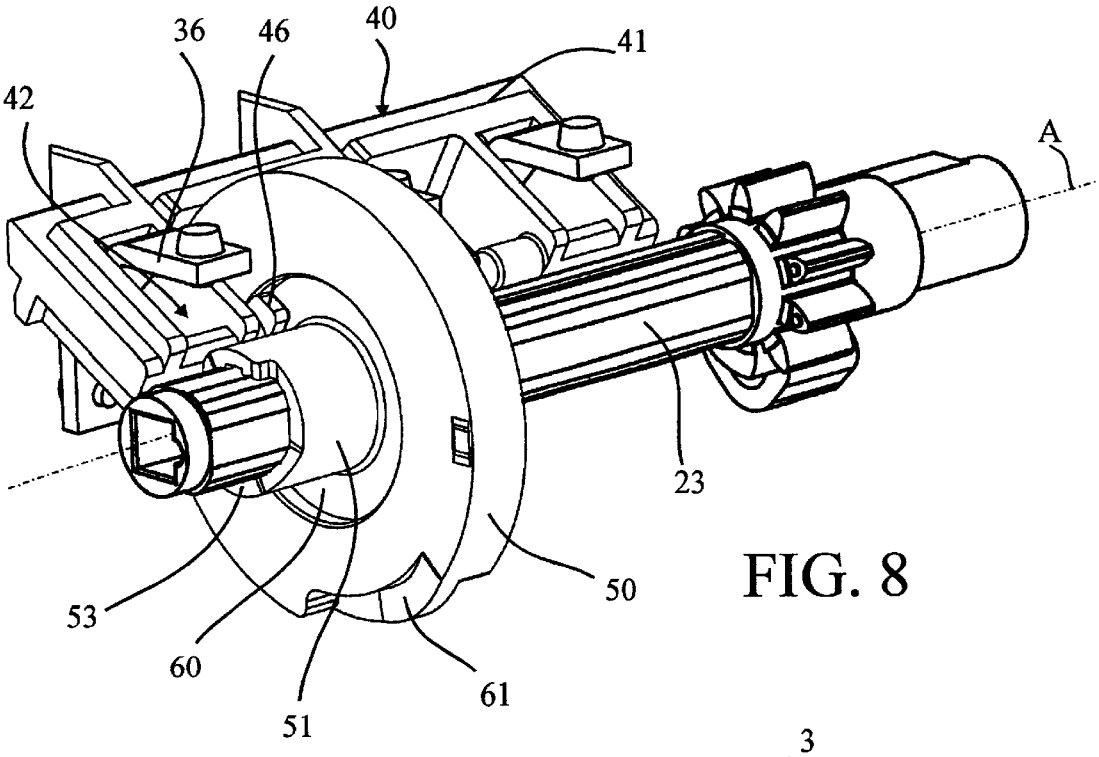
FIG. 8 is a partial perspective showing the rear of the cam.

This disconnector 1 also comprises a test position shown by FIGS. 6 to 8. This test position makes it possible to activate auxiliary contacts arranged for example on the control module 2 to test their control circuits, making it possible to check the disconnnector's engaged or released condition. This test position is obtained by turning the handle of said device at an angle of 60 to 90° in the opposite direction to that when engaging. During this rotation, the moving elements 40 must not move and the disconnector 1 must remain in the released position. Each recess 55 is extended by a test track 58, framed by the inner walls 55*a* and outer walls 55*b*, this track being circular, close to the control shaft 23, with a constant radius and centered on the axis A, ending with a tracking band 59 corresponding to the end of the drive finger 45 in the test position. On the rear side of the cam 50 a circular groove 60 is provided close to the control shaft 23 and centered on the axis A. This circular groove 60 is designed to receive the guide shoe 46 provided on the moving elements 40 facing the drive finger 45. It makes it possible to ensure the guiding of the moving elements 40 in relation to the cams 50 de so that, when the test phase is over, the drive finger 45 is positioned again in the right track, i.e. the out track 46.

On FIG. 8, it can be seen that the cam 50 comprises a thinner peripheral zone 61 which serves a double purpose. It first of all allows the cam 50 to be mounted in the frame 41 of the moving element 40, between the drive finger 45 and the guide shoe 46. It then allows the cap (not shown) of the disconnector 1 to be locked automatically when the latter is in the engaged position, by means of an additional device provided on said cap.

In the above description, it can be seen that the invention makes it possible to achieve all the aims mentioned. In conclusion, it makes it possible to substantially lower the cost of manufacturing the disconnecting modules and therefore the cost of the disconnector whilst improving its technical performance. What is more, apart from the current-carrying parts which are made for example of copper, virtually all the parts of the drive mechanism of the moving contacts can be made by molding in a technically suitable material, e.g. thermoplastic or thermoset.

The present invention is not restricted to the example of embodiment described but can be widened to include any modification and alternative which is obvious for an expert. Of course, the number of disconnecting modules depends on the number of phases in the installation with the presence or not of a neutral conductor. As a result, the number of fixed contacts, moving contacts, cams, windows and notches provided in the frame of the moving equipment is adapted accordingly. Likewise, the shape of the various parts comprising said control mechanism of the moving contacts can vary whilst remaining within the scope of protection defined in the claims. In particular, the layout of the out, return and test tracks illustrated and described is only given by way of example.

What is claimed is:

1. Electrical disconnector (1) for a alternating low voltage electrical installation provided with at least two phase conductors with or without neutral conductor, comprising one disconnecting module (3) per conductor and one joint control module (2) provided with a mechanism for operating said disconnecting modules, each disconnecting module comprising at least one input terminal (30) connected to a fixed contact (31), one output terminal (32) connected to a fixed contact (33), another two fixed contacts (31', 33') connected to one another by a bridge or a fuse, forming with the other fixed contacts two pairs of fixed contacts and two moving contacts (35, 36) associated respectively with a pair of fixed contacts, the control module (2) comprising at least one control shaft (23) coupled to an operating handle, this shaft crossing said disconnecting modules (3) and bearing at least one cam (50) coupled to at least one translation moving element (40) coupled to said moving contacts (35, 36) to move them from a first stable position called the engaged position to a second stable position called the released position, wherein each moving contact (35, 36) comprises two contact surfaces (38) arranged in substantially perpendicular planes, and the fixed contacts (31, 31' and 33, 33') of the same pair are arranged in substantially perpendicular planes so that their respective contact surface (37) is placed facing the corresponding contact surface (38) provided on said moving contact (35, 36) when it is in the engaged position and each moving contact (35, 36) moves in radial translation in relation to the control shaft (23) in a substantially perpendicular direction (F) to a straight line passing through its two contact surfaces (38).

2. Device according to claim 1, wherein each moving contact (35, 36) comprises two end arms arranged on either side of a middle arm forming an angle of approximately 45° in relation to said middle arm, the contact surfaces (38) being provided on the two end arms.

3. Device according to claim 1, wherein the moving element (40) is made up of a substantially rectangular frame (41) extending through said disconnecting modules (3) and arranged in an inclined plane parallel to the control shaft (23).

4. Device according to claim 3, wherein the frame (41) comprises at least two parallel sides (47), oriented radially in relation to the control shaft (23) and arranged to slide along two corresponding sides (48) arranged in an enclosure (4) of said device to guide said frame (41) in translation.

5. Device according to claim 3, wherein the frame (41) comprises for each corresponding moving contact (35, 36) a window (42) oriented substantially perpendicular to the control shaft (23) and a return spring (43) housed in this window (42) to attract said moving contact (35, 36) in the direction of the fixed contacts (31, 31' and 33, 33').

6. Device according to claim 3, wherein the frame (41) comprises at least one notch (44) designed to receive said cam (50), at least one side of this notch comprising a drive finger (45) substantially parallel to the control shaft (23) and engaged in at least one track (56, 57) provided in said cam (50).

7. Device according to claim 6, wherein the cam (50) comprises, for each moving element (40), a non circular recess (55), delimited by an inner wall **(55*a*) close to the control shaft (23) and an outer wall (55*b*) at a distance from the control shaft (23), these walls being arranged to guide said drive finger (45)**, respectively when engaging and releasing.

8. Device according to claim 7, wherein the bottom of the recess (55) comprises various reliefs arranged to define, respectively with the inner walls **(55*a*) and outer walls (55*b*), two distinct tracks (56, 57), i.e. an out track (56) for engaging purposes and a return track (57)** for releasing purposes.

9. Device according to claim 8, wherein the out track (56) comprises a first part **(56*a*) which is substantially rectilinear and a second circular part (56*b*) with a small radius out-of-center in relation to the control shaft (23) and the return track (57) comprises a first circular part (57*a*) with a constant radius centered on the control shaft (23) and a second circular part (57*b*)** the radius of which is smaller than said constant radius.

10. Device according to claim 9, wherein the second part **(56*b*) of the out track (56) communicates with the first part (57*a*) of the return track (57) via a shoulder (56*c*)**.

11. Device according to claims 8, wherein the cam (50) comprises a central barrel (51) rotating securely fixed to the control shaft (23) and sliding on the latter and in that the width of the notch (44) provided in the moving element's frame (41) is greater than that of the cam (50) which allows it an axial clearance (D) corresponding to the differences in relief at the bottom of the recess (55).

12. Device according to claim 11, wherein on at least one of its free ends, the barrel (51) has a cam profile (53) co-operating with at least one lug (54) provided at least in the enclosure (4) of said device and oriented radially in relation to the control shaft (23) and in that the control shaft (23) bears a return spring (52) arranged to keep the cam profile (53) resting on said lug (54).

13. Device according to claim 8, wherein the recess (55) is extended, in a direction opposite to that of the out track (56) and return track (57), by a test track (58), framed by the inner **(55*a*) and outer walls (55*b*), this track (58) being circular, close to the control shaft (23)**, with a constant radius centered on this shaft.

14. Device according to claim 13, wherein the cam (50) comprises on its rear side a circular groove (60) near the control shaft (23) and centered on this shaft and the frame (41) of the moving element (40) comprises a guide shoe (46) arranged facing the drive finger (45) and arranged to lodge itself in said groove (60) when the device is in the test position.

* * * * *